US005699644A

United States Patent [19]

Smith

[11] Patent Number: 5,699,644

[45] Date of Patent: Dec. 23, 1997

[54] PREFABRICATED BUILDING PANEL

[76] Inventor: Rodney I. Smith, Rte. 2, Box 7, Midland, Va. 22728

[21] Appl. No.: 733,337

[22] Filed: Oct. 17, 1996

Related U.S. Application Data

[63] Continuation of Ser. No. 490,517, Jun. 14, 1995, abandoned, which is a continuation of Ser. No. 509,216, May 8, 1990, abandoned, which is a continuation-in-part of Ser. No. 434,327, Nov. 13, 1989, abandoned, which is a continuation-in-part of Ser. No. 210,322, Jun. 23, 1988, abandoned.

[51] Int. Cl.[6] ..... E04C 2/38; E04C 2/288

[52] U.S. Cl. ..... 52/801.1; 52/404.2; 52/405.1; 52/800.1

[58] Field of Search ..... 52/414, 404.2, 52/405.1, 327, 337, 600, 602, 477, 508, 511, 454, 334, 335, 336, 362, 363, 351, 800.1, 801.1

[56] References Cited

U.S. PATENT DOCUMENTS

| | | | |
|---|---|---|---|
| 1,882,499 | 10/1932 | Johns | 52/454 |
| 1,925,774 | 9/1933 | Phillips | 52/362 |
| 1,941,211 | 12/1933 | Inglee | 52/329 |
| 1,986,690 | 1/1935 | Thomson | 52/221 |
| 2,294,139 | 8/1942 | Strong | 52/602 |
| 2,466,106 | 4/1949 | Hoge | 52/587 |
| 2,692,496 | 10/1954 | Thomas | 52/363 |
| 3,138,899 | 6/1964 | Hadley | 52/334 |
| 3,142,938 | 8/1964 | Eberhardt | 52/511 |
| 3,452,502 | 7/1969 | Price | 52/690 |
| 3,511,127 | 5/1970 | Gisondi | 52/362 |
| 3,600,868 | 8/1971 | Wilson | 52/334 |
| 3,802,147 | 4/1974 | O'Konski | 52/630 |
| 4,494,349 | 1/1985 | Clements | 52/633 |
| 4,558,552 | 12/1985 | Reitter, II | 52/454 |
| 4,623,290 | 11/1986 | Kikuzawa et al. | 411/908 |
| 4,768,322 | 9/1988 | Kafarowski | 52/511 |

FOREIGN PATENT DOCUMENTS

| | | | |
|---|---|---|---|
| 118 | 1/1979 | European Pat. Off. | 52/511 |
| 2536442 | 11/1982 | France | 52/583 |
| 673610 | 6/1952 | United Kingdom | 52/587 |

*Primary Examiner*—Michael Safavi
*Attorney, Agent, or Firm*—Whithman, Curtis, Whitham & McGinn

[57] ABSTRACT

A prefabricated, reinforced construction panel consisting of a cast, concrete slab which is reinforced by rigid channels or studs. The studs are attached to the slab by thermally non-conductive connectors imbedded in the slab and joined to the reinforcing channels or studs to create an energy efficient light weight and durable panel. An insulation layer may be placed between the channels or studs and the concrete slab. The space between the reinforcing channels or studs may also be filled with insulating material.

5 Claims, 6 Drawing Sheets

PREFABRICATED BUILDING PANEL

This is a continuation of application Ser. No. 08/490,517, filed Jun. 14, 1995, now abandoned, which is a continuation of application Ser. No. 07/509,216, filed May 8, 1990, now abandoned, which is a continuation-in-part of application Ser. No. 07/434,327, filed Nov. 13, 1989, now abandoned, which is a continuation-in-part of application Ser. No. 07/210,322, filed Jun. 23, 1988, now abandoned.

SUMMARY OF THE INVENTION

The present invention is concerned with a prefabricated, concrete construction panel which is reinforced by rigid elongated members such as metal studs that are attached to the slab of concrete by means of thermally non-conductive lugs which joined to the reinforcing member and which project into the slab of concrete and hold it at a distance from the reinforcing member.

BACKGROUND OF THE INVENTION

Prefabricated construction panels have found increasing use in the construction industry because of their versatility and economy of manufacture. These panels can be fabricated from a number of materials and concrete construction panels have found particular application in exterior structures and surfaces. Such concrete construction panels frequently are reinforced by rigid members which are either imbedded in the concrete panel or attached to the concrete panel externally to provide further strength and rigidity. It has, for example, been known to reinforce prefabricated cast concrete panels by partially imbedding longitudinally disposed steel beams in the cast slab. Such structures, have however, had the disadvantage that weaknesses are created by the imbedded structure in the concrete surface and "shadow lines" may become visible from the opposite side in the areas where the reinforcing beams are imbedded.

The additional disadvantage is the high conductivity and transmission of heat or cold where the channel or stud is directly buried in the concrete or attached to the concrete with a connector of metal that conducts heat or cold thru the panel resulting in the effcient use of energy.

An additional technique for providing external reinforcement to precast concrete slabs is to provide a rigid structural member having welded wires projecting from it which can be imbedded into the concrete when it is cast into a slab as shown in German Patent 3,419,315. Such reinforcing members are however, quite costly and tedious to assembly since the attaching wires must individually be welded onto the rigid reinforcing stud or beam. They also provide an undesireable thermally conductive connection which Additionally, it is known to connect concrete slabs with reinforcing structures by means of various metallic connectors such as tabs formed in steel studs as disclosed in U.S. Pat. No. 3,802,147 to O'Konski. The metallic connectors commonly used in the prior art have, however, the serious disadvantage that they are excellent thermal conductors which function effectively to conduct heat between the concrete slab and the metal reinforcing structure. The metallic reinforcing structure is itself highly thermally conductive and thus becomes a "radiator" for the slab to which it is attached.

It is accordingly, an object of the present invention to provide a reinforced, prefabricated construction panel which can be quickly and inexpensively fabricated without the need for time consuming manual procedures.

It is a further object of the present invention to provide a prefabricated construction panel having a unique structural reinforcement which is attached to the panel by thermally non-conductive attachment means which are joined to the reinforcing member and which thereby avoid transfer of thermal energy between the panel and the reinforcing member.

The achievement of these and other objects of the present invention will, however, become apparent by considering the present invention in detail as described herein.

DETAILED DESCRIPTION OF THE INVENTION AS ILLUSTRATED IN THE DRAWINGS

In accordance with the present invention, a prefabricated concrete construction panel is provided which comprises a concrete slab which is connected by means of a plurality of thermally non-conductive projections to a series of rigid reinforcing beams or studs. The projections which connect the slab with the reinforcement channels are imbedded within the slab and the respective reinforcement channels. In the alternative, the ends of the reinforcement lugs can be joined to reinforcing structures such as mats or wire which is also imbedded in the concrete when the slab is cast.

Figure 1:
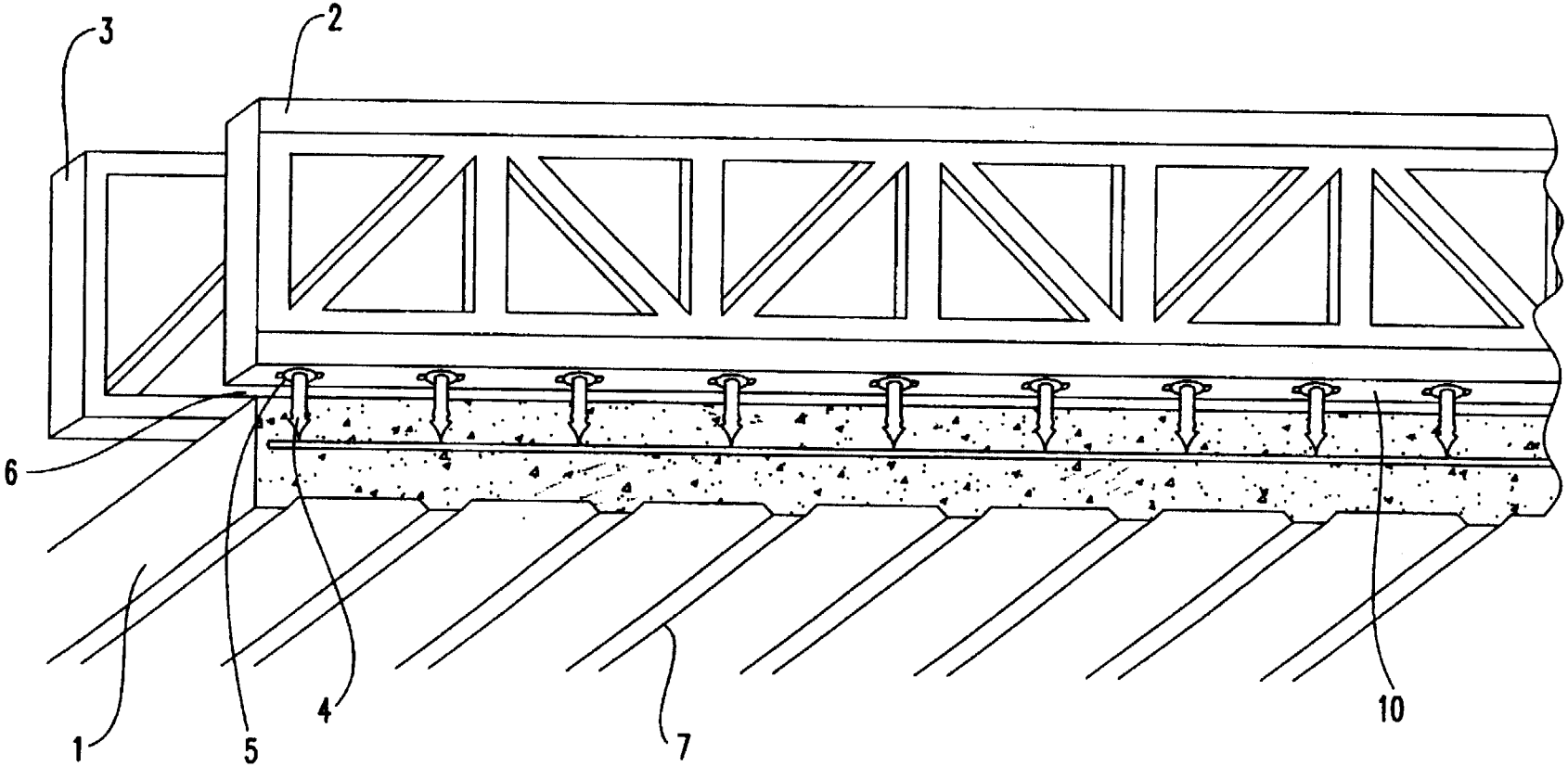
FIG. 1 is a side, partially cut-away view of a reinforced concrete construction panel of the present invention.

The invention will, however, be more fully appreciated by having reference to the appended drawings which describe a preferred embodiment thereof. Directing attention to FIG. 1 of the drawings, a cast concrete slab 1 is provided having parallel ridges, ribs or other finishes 7 on one side and joined to a series of rigid reinforcement channels 2 and 3 on the other side. The rigid reinforcing channels are normally made of a metal such as steel or aluminum which may be provided with a protective finish to inhibit corrosion and rust. The bottom edge 6 of the reinforcing channels are joined by means of downward projecting lugs 4, which lock into slots 5 in the beam and project into the concrete slab 1. It will be apparent, that most advantageously, the joining of the downward projecting lugs 4 with the concrete slab 1 is done by placing the lugs and reinforcing beams into the uncured concrete slab before it has had an opportunity to harden or alternatively, by casting the slab around the ends of the downward projecting lugs. Normally, a distance of about one to one and one-half inches is provided between the top of the slab 1 and the bottom 6 of the reinforcing channel.

Figure 2:
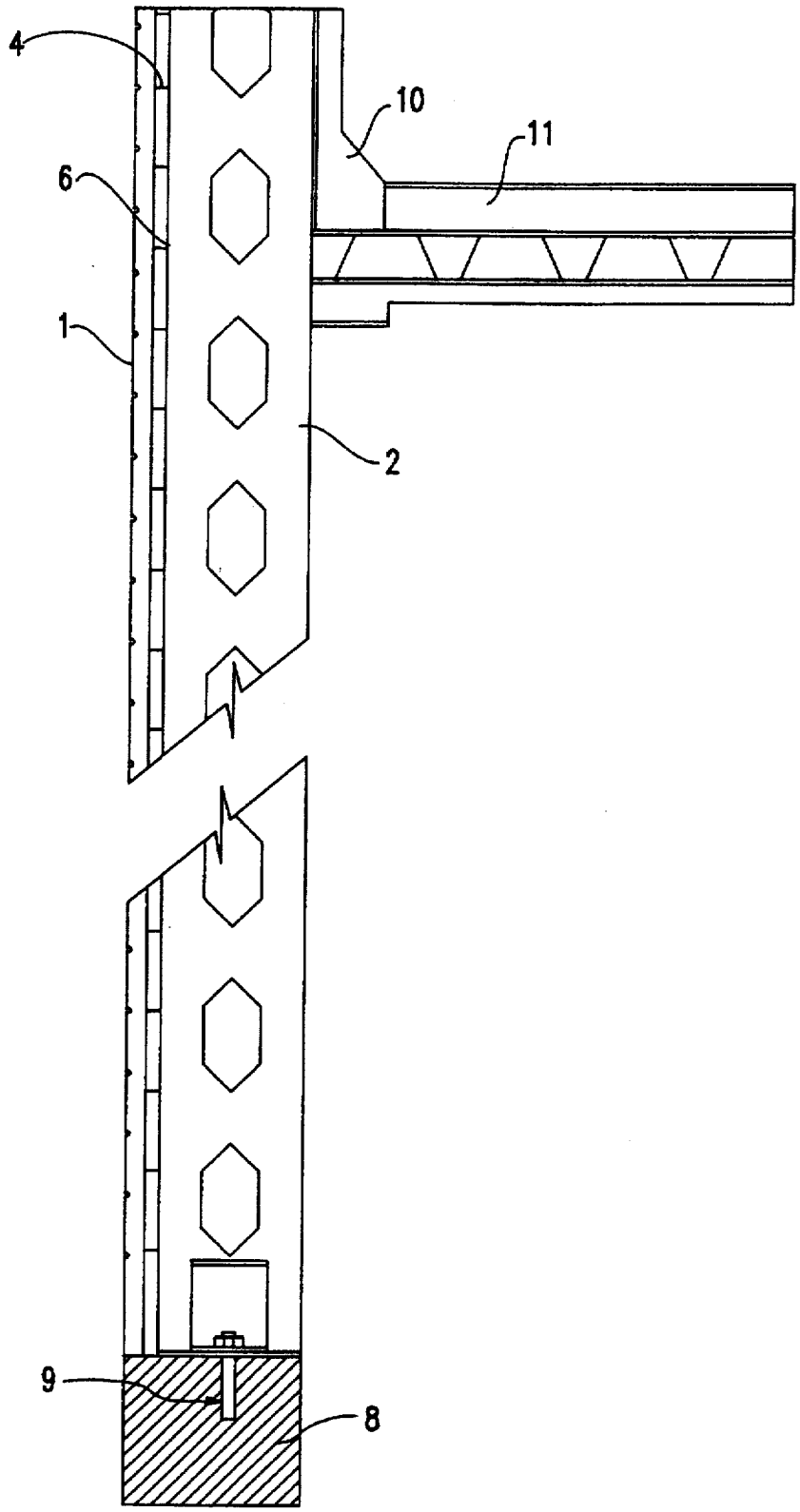
FIG. 2 is a side view illustrating the reinforced concrete panel of the present invention.

FIG. 2 of the drawings provides an additional side view of the present invention in which the upright reinforcing channel or stud 2 is attached by means of bolts to a structural member 8 and by means of bracket 10 to horizontal structural member 11. The cast concrete slab 1 is joined by means of lugs 4 to the stud 2.

Figure 3:
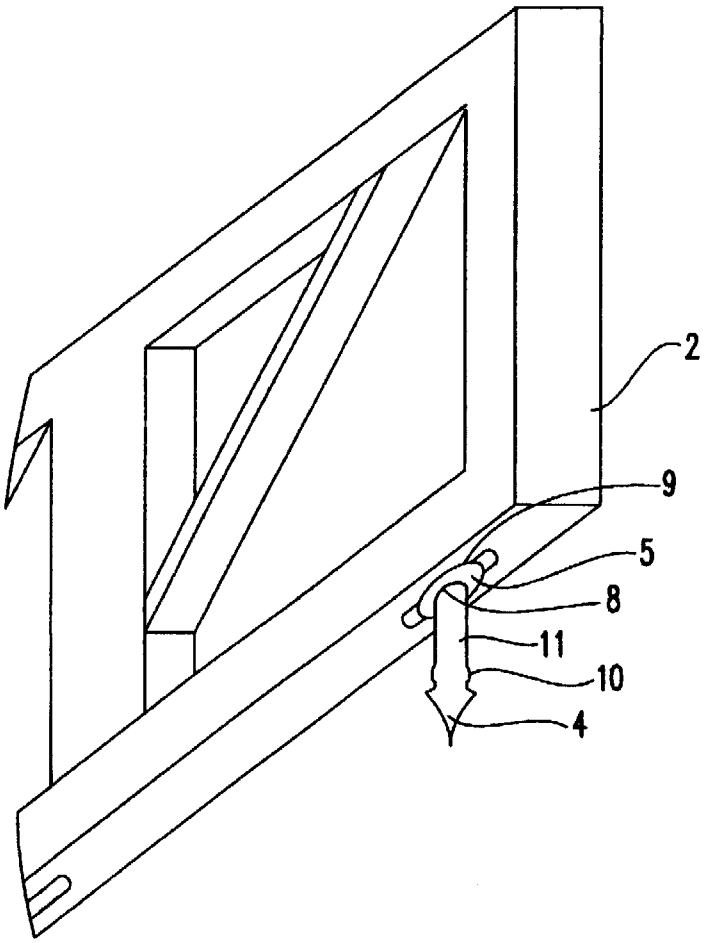
FIG. 3 is a partial view of a reinforcing member of the present invention illustrating the connecting means which are joined with the reinforcing member.

Directing attention to FIG. 3 of the drawings, a preferred mode for joining the downward projecting lugs 4 with the metal reinforcing channel 2 is shown whereby slots or round holes 9 are provided in the reinforcement beam to accommodate one end of the lug 4.

Figure 4:
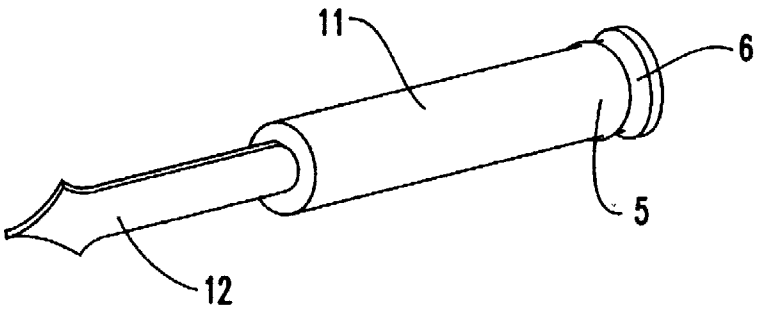
FIGS. 4 and 5 illustrate two configurations of the thermally non-conductive lugs of the invention.
Figure 5:
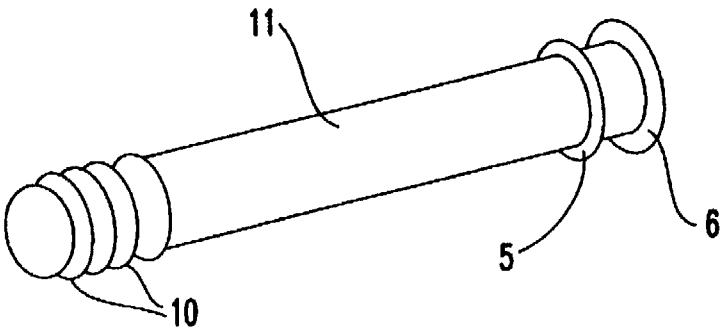

Lug 4, which is shown in two configurations in FIGS. 4 and 5, is an elongated cylinder having a shank 11 and two spaced flanges 5 and 6, provided at one end to anchor the lug securely within slot 9. Advantageously, one or both of the flanges have an elongated or elliptical configuration to facilitate insertion into the slot. Twisting of the lug within the slot to rotate the flanges then secures the lug in place. The end of the lug which extends into the concrete slab is asymetric in configuration to inhibit withdrawal once the concrete has hardened around it. As shown for example in FIG. 5, radial ridges 10 are provided; and in FIG. 4 a wedge shaped projection 12 extends from the end of shank 11. Other similar configurations can also be used to secure the lug to the concrete slab such as lateral projections or grooves on shank 11. It is an especially important feature of the invention that the lugs used to join the reinforcing member to the slab be made of a thermally non-conductive material in order to minimize heat flow between the slab and the metal reinforcement. Typical of the materials from which the lugs can be made are fiberglass, nylon, other plastic and graphite fiber composites. Other materials such as polymers having sufficient rigidity, strength and resistance to degradation can also be used.

Figure 6:
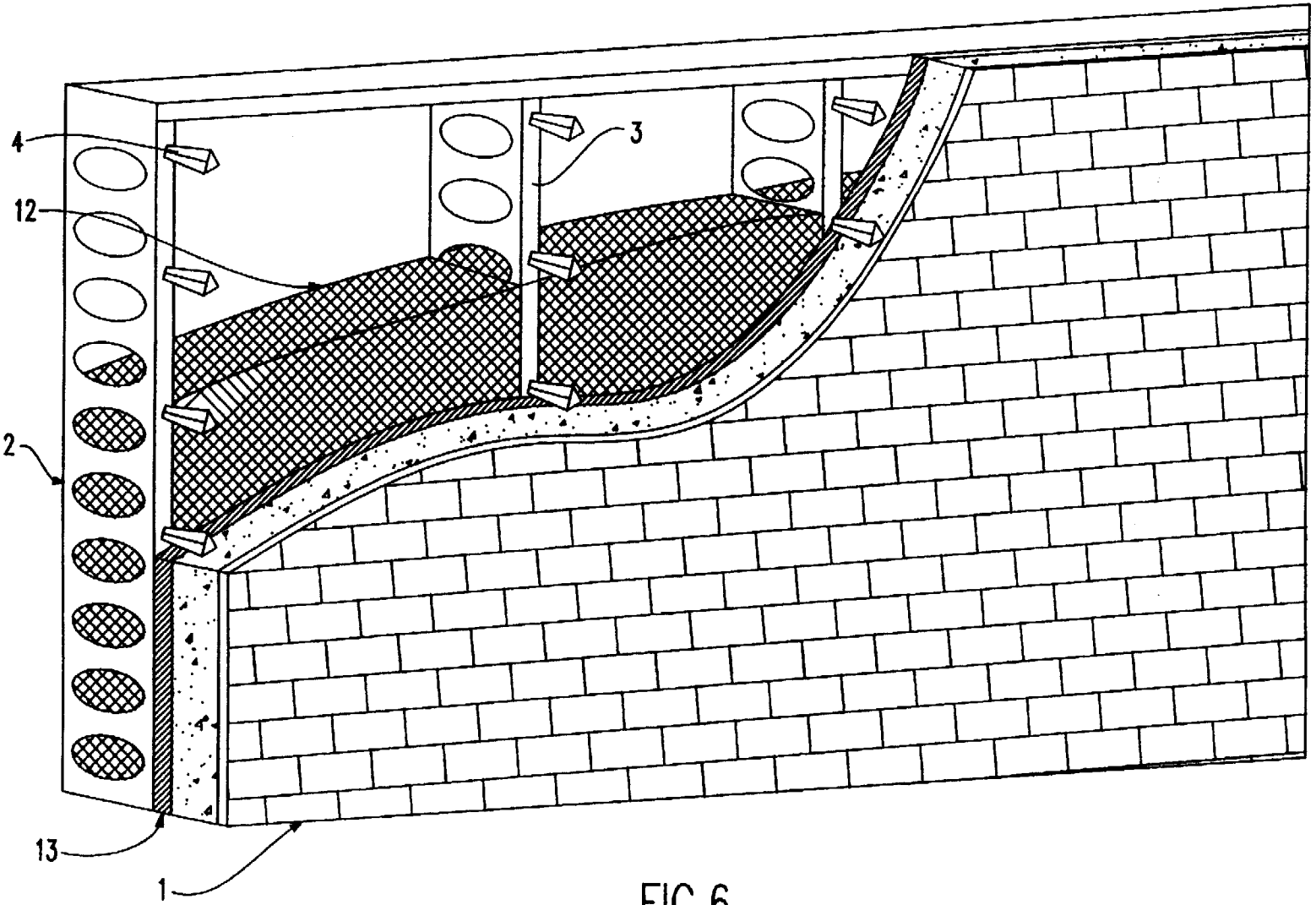
FIG. 6 is a frontal, partially cut away view of the present invention.

As shown in FIG. 6 of the drawing, the space between the reinforcing members can be filled with insulating material 12 such as fiberglass, polyurethane or polystyrene to form a unitary, insulated structure. Additionally, insulation 13 can be provided between the reinforcing structure and the slab 1 itself.

Figure 7:
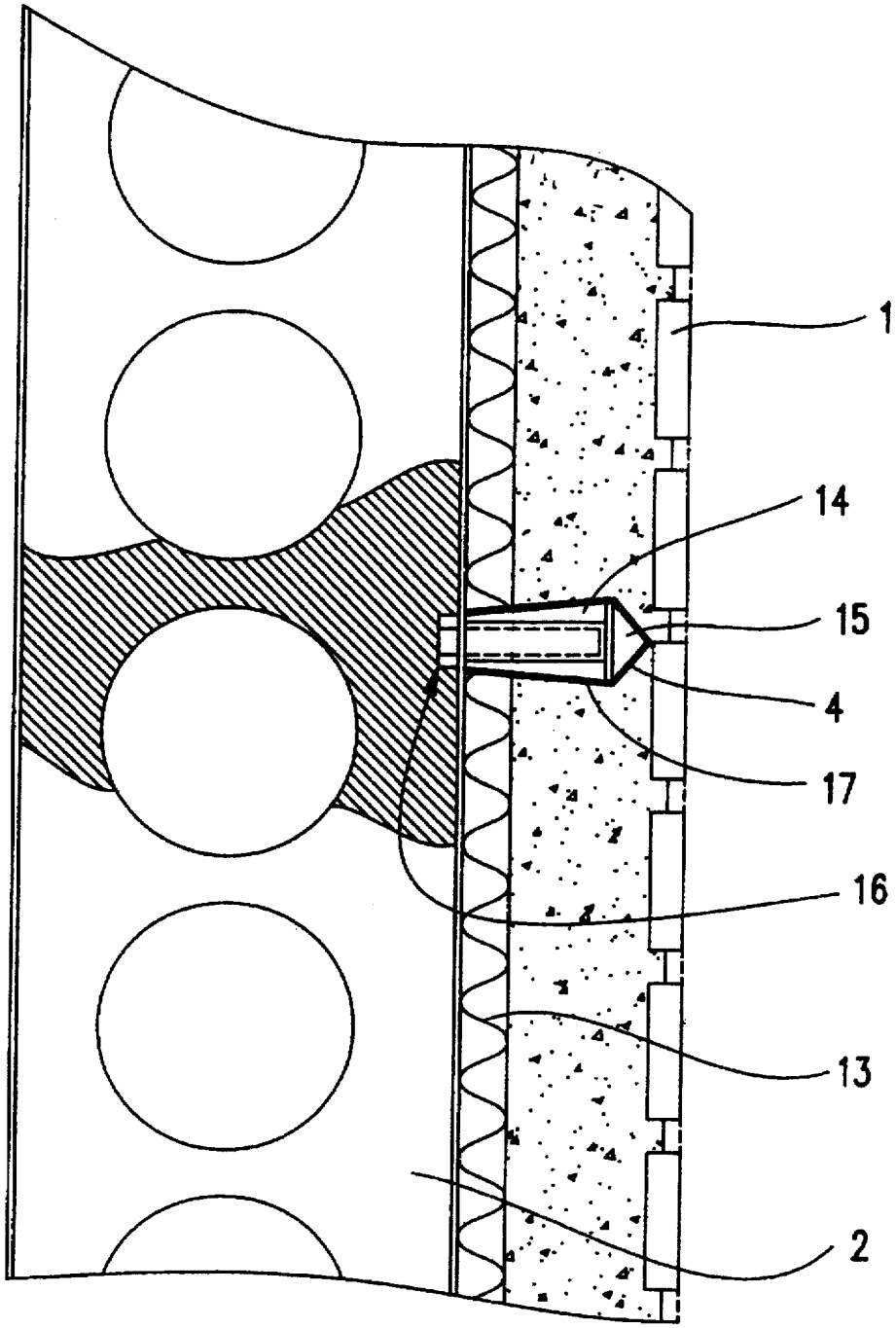
FIG. 7 is a side view of the invention illustrating a preferred embodiment.

FIG. 7 of the drawings illustrates a particularly preferred embodiment of the invention whereby connector 4 is conical in shape and consists of a metal body 14 with a plastic coating 17 having a gradually enlarged diameter to resist removal from slab 1 and a pointed head 15 to facilitate initial placement into the concrete aggregate. Attachment of the connector 4 to the stud 2 can be by means of a bolt 16 which screws into a cavity in the connector.

Although many variations are, of course, within the scope of the present invention, depending on the particular application, and requirements of the reinforced panels, generally the connecting lugs will project into the concrete slab approximately ¾ to 1½ inches. The connecting lugs will frequently be spaced about 18"–30" inches apart with approximately 24 inch distances being most common. The spacing of the reinforcing beams will, of course, again depend upon the degree of reinforcement and structural application of the panel, but frequently, will be approximately 18–30 inches.

A principle advantage of the present invention is that, in addition to permitting the rapid and inexpensive fabrication of rigidly reinforced construction panels without the need for time-consuming and laborious welding, it provides a reinforced structure with minimal heat transfer or loss between the slab and the reinforcing members. According to the present invention, the connector lugs which project downward from a surface of each of the respective reinforcing beams, are made of a thermally non-conductive material and have a configuration which facilitates their emplacement in a way which is considerably more economical and generally satisfactory than prior procedures of welding lugs or other .projections to the metal reinforcing beams. This permits the fabrication of a generally superior and less expensive reinforced cast construction panel having improved thermal qualities.

Other advantages and modifications of the present invention will be apparent to those having ordinary skill in the art and are considered to fall within the scope of the claims appended hereto.

What is claimed:

1. A prefabricated, construction panel comprising a slab having permanently imbedded therein a plurality of thermally non-conductive spaced lugs for permanently securing said slab to rigid means for structurally reinforcing said panel, said lugs being joined to said reinforcement means and projecting into one surface of said slab to maintain a fixed separation forming a space between said slab and said reinforcement means, and wherein at least a portion of the part of said lugs which project into the slab has an asymmetric configuration comprising a progressively wider taper as it extends into the slab.

2. The construction panel of claim 1 wherein said separation between said slab and reinforcement means is a space filled with thermal insulation.

3. A prefabricated construction panel comprising a slab having permanently imbedded therein a plurality of thermally non-conductive spaced conical lugs which have increasing diameter as they project into said slab and terminate in a pointed head which projects into said slab for permanently securing said slab to rigid means for structurally reinforcing said panel, said conical lugs being joined to said reinforcement means and projecting into one surface of said slab to maintain a fixed separation forming a space between said slab and said reinforcement means.

4. The construction panel of claim 3 wherein said lug is made of a thermally non-conductive material.

5. The construction panel of claim 3 wherein said lug is attached to said reinforcement means by a bolt extending axially into said lug.

* * * * *